US009859645B2

(12) United States Patent
Ohfuku et al.

(10) Patent No.: US 9,859,645 B2
(45) Date of Patent: Jan. 2, 2018

(54) CONNECTOR INCLUDING A TERMINAL RETAINER

(71) Applicant: YAZAKI CORPORATION, Tokyo (JP)

(72) Inventors: Ryosuke Ohfuku, Shizuoka (JP); Tomoyoshi Fukaya, Shizuoka (JP); Masatoshi Nakamura, Shizuoka (JP); Kazuhide Ikeya, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/259,747

(22) Filed: Sep. 8, 2016

(65) Prior Publication Data

US 2017/0069983 A1 Mar. 9, 2017

(30) Foreign Application Priority Data

Sep. 9, 2015 (JP) ..... 2015-177412

(51) Int. Cl.
*H01R 9/22* (2006.01)
*H01R 13/436* (2006.01)

(52) U.S. Cl.
CPC ..... *H01R 13/4361* (2013.01)

(58) Field of Classification Search
CPC ..... H01R 9/2416; H01R 13/432
USPC ..... 439/722
See application file for complete search history.

(56) References Cited

U.S. PATENT DOCUMENTS 4,772,229 A * 9/1988 Nix ..... H01R 13/4362 439/733.1
5,167,534 A * 12/1992 Ohsumi ..... H01R 13/4362 439/595
5,769,650 A * 6/1998 Aoyama ..... H01R 13/4365 439/189

(Continued)

FOREIGN PATENT DOCUMENTS

JP 10-199603 A 7/1998
JP 2001-185272 A 7/2001

(Continued)

OTHER PUBLICATIONS

Japanese Office Action for the related Japanese Patent Application No. 2015-177412 dated Aug. 22, 2017.

*Primary Examiner* — Abdullah Riyami
*Assistant Examiner* — Nader Alhawamdeh
(74) *Attorney, Agent, or Firm* — Kenealy Vaidya LLP

(57) ABSTRACT

A connector includes a tubular connector housing inside which a terminal accommodating room is formed, a terminal that is inserted into the terminal accommodating room from behind, and a retainer that retains the terminal which is accommodated in the terminal accommodating room by being mounted to the connector housing from a direction crossing the inserting direction of the terminal, wherein the retainer is formed with a terminal contact part which is inserted from an opening, with which a wall of the terminal accommodating room of the connector housing is formed, to touch the terminal which is accommodated in the terminal accommodating room, and the terminal contact part is formed into such a shape to push the terminal toward the front side of the terminal accommodating room in a process that the retainer moves to a regular position of the connector housing.

8 Claims, 6 Drawing Sheets

(56) References Cited

U.S. PATENT DOCUMENTS

| | | | | |
|---|---|---|---|---|
| 6,220,886 | B1 * | 4/2001 | Kurimoto | H01R 13/639 439/347 |
| 2002/0081912 | A1 | 6/2002 | Sakurai et al. | |
| 2002/0086588 | A1 | 7/2002 | Fujita | |
| 2009/0004924 | A1 | 1/2009 | Denpouya et al. | |
| 2010/0048054 | A1 | 2/2010 | Okayasu | |
| 2010/0068911 | A1 * | 3/2010 | Nagano | H01R 13/424 439/345 |
| 2012/0156945 | A1 * | 6/2012 | Matsumura | H01R 13/4364 439/744 |
| 2015/0099384 | A1 * | 4/2015 | Morello | H01R 13/521 439/271 |

FOREIGN PATENT DOCUMENTS

| | | | |
|---|---|---|---|
| JP | 2002-170621 | A | 6/2002 |
| JP | 2005-044586 | A | 2/2005 |
| JP | 2008-21498 | A | 1/2008 |
| JP | 2010-49896 | A | 3/2010 |
| JP | 2010-73375 | A | 4/2010 |
| JP | 2012-64463 | A | 3/2012 |

* cited by examiner

FIG. 6A1
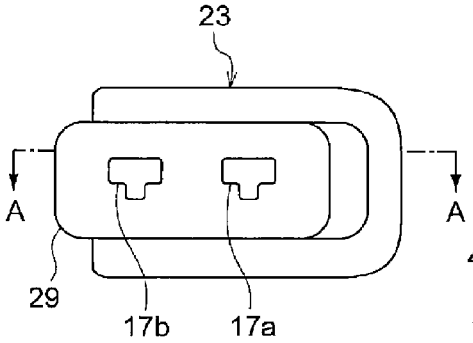
FIG. 6A2
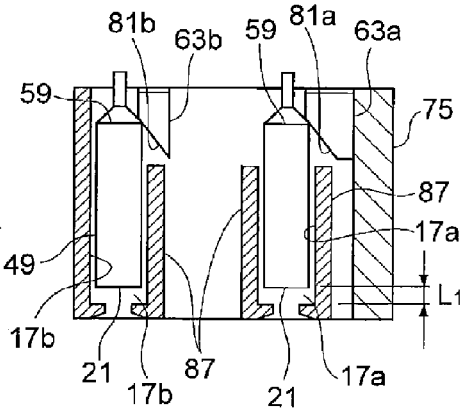
FIG. 6B1
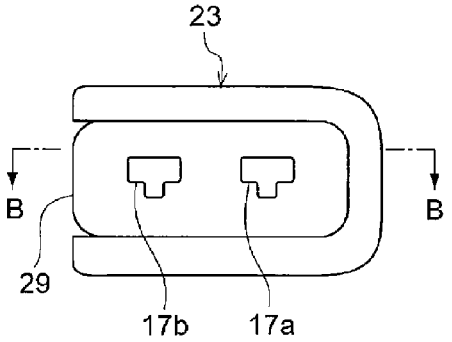
FIG. 6B2
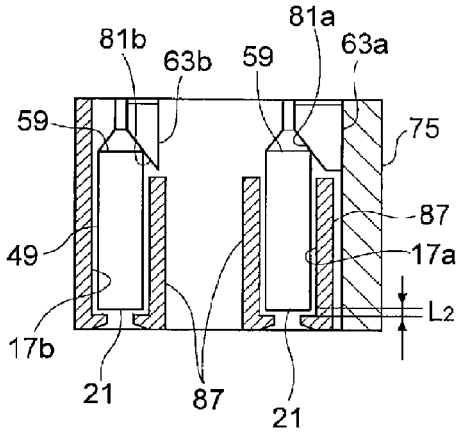

CONNECTOR INCLUDING A TERMINAL RETAINER

CROSS REFERENCE TO RELATED APPLICATION

This application is based on Japanese Patent Applications No. 2015-177412 filed on Sep. 9, 2015, the contents of which are incorporated herein by reference.

BACKGROUND OF THE INVENTION

1. Technical Field

The present invention relates to a connector, and particularly to a connector that includes a retainer to retain a terminal accommodated in a terminal accommodating room of a housing.

2. Background Art

A connector is recorded in JP-A-2012-64463, in which by inserting a terminal into a terminal accommodating room of a connector housing from behind, mounting a retainer to the connector housing from a direction perpendicular to the inserting direction of this terminal, and locking the terminal inserted into the terminal accommodating room with the retainer, it is prevented that the terminal is removed from the terminal accommodating room.

When the terminal is being inserted into the terminal accommodating room, the retainer abuts against the terminal so that the retainer is regulated from being mounted to a regular position of the connector housing. When the terminal has been completely inserted into the terminal accommodating room, because a distal end is inserted into the terminal accommodating room, it becomes possible that the retainer is mounted to the regular position.

Because the distal end, which is inserted into the terminal accommodating room, of the retainer, which is mounted to the regular position, regulates the movement of the terminal in the removing direction, the terminal accommodated in the terminal accommodating room can be maintained.

However, for JP-A-2012-64463, looseness may occur at the terminal which is accommodated in the terminal accommodating room. For example, when a part of the retainer is inserted into the terminal accommodating room, to prevent that the retainer is damaged by touching the terminal that is accommodated in the terminal accommodating room, a predetermined gap between the end surface of the terminal opposed to the retainer and the retainer may be provided. Therefore, looseness corresponding to the size of the gap occurs at a female terminal, and a drop of contact reliability with a mating terminal is concerned.

The object of the present invention is to provide a connector so that the looseness of a terminal accommodated in a terminal accommodating room can be inhibited.

SUMMARY OF THE INVENTION

[1] According to an aspect of the invention, a connector includes a tubular connector housing inside which a terminal accommodating room is formed, a terminal that is inserted into the terminal accommodating room from behind, and a retainer that retains the terminal which is accommodated in the terminal accommodating room by being mounted to the connector housing from a direction crossing the inserting direction of the terminal. The retainer is formed with a terminal contact part which is inserted from an opening, with which a wall of the terminal accommodating room of the connector housing is formed, to touch the ten which is accommodated in the terminal accommodating room, and the terminal contact part is formed into such a shape to push the terminal toward the front side of the terminal accommodating room in a process that the retainer moves to a regular position of the connector housing.

With the configuration [1], in a process that the retainer moves to a regular position of the connector housing, when the terminal contact part is pushed against the terminal, and the terminal is pushed to the front side of the terminal accommodating room, and mounted to a regular position of the connector housing, the terminal is regulated from moving to the back side of the terminal accommodating room. Thereby, because the terminal that is pushed into the terminal accommodating room can be held in the terminal accommodating room, the looseness of the terminal can be restrained.

[2] In the connector according to [1], the terminal contact part is formed to have an inclined surface which is inclined toward a direction of pushing the terminal toward the front side of the terminal accommodating room.

With the configuration [2], because the terminal can be pushed along the inclined surface of the terminal contact part in a direction different from the mounting direction of the retainer, the design flexibility of the retainer can be raised.

[3] In the connector according to [2], the connector housing is formed with a plurality of the terminal accommodating rooms which are placed side by side, the retainer has a plurality of the terminal contact parts which correspond to the terminal accommodating rooms, respectively, and the terminal contact parts are provided at positions that are shifted from each other so that the inclined surfaces do not overlap in the direction of projecting toward the opening.

With the configuration [3], when the retainer is formed of synthetic resin by injection molding, the design flexibility when the inclined surfaces of the terminal contact parts are molded with one sliding mold at the same time can be raised.

[4] On the other hand, instead of that the terminal contact part is formed with the inclined surface, the present invention can be constructed as follows. That is, in the connector [1], the connector housing is formed at the opening with a guiding surface which is inclined in a direction of guiding the retainer to the front side of the terminal accommodating room, the retainer has a sliding surface to slide along the guiding surface, and the surface that touches the terminal of the terminal contact part is formed into a planar shape to extend in a direction perpendicular to the inserting direction of the terminal.

With the configuration [4], when the sliding surface of the retainer moves along the guiding surface, the whole retainer moves toward the inserting direction of the terminal, and moves while the terminal contact part pushes the terminal forward. For the retainer which is mounted to the regular position of the connector housing, the planar terminal contact part that extends in the direction perpendicular to the inserting direction of the terminal regulates the movement backward of the terminal. Therefore, according to the present invention, because the terminal contact part touches the terminal that is accommodated in the terminal accommodating room in a wide area and the movement in the removing direction can be regulated, the retentivity of the terminal can be stabilized more.

According to the connector of the present invention, the looseness of a terminal which is accommodated in a terminal accommodating room can be inhibited.

BRIEF DESCRIPTION OF DRAWINGS

FIGS. 6A1 to 6B2 describe movement when the retainer is mounted. FIG. 6A1 is a side view while the retainer is locked provisionally. FIG. 6A2 is a sectional view from A-A arrows of FIG. 6A1. FIG. 6B1 is a side view while the retainer is really locked. FIG. 6B2 is a sectional view from B-B arrows of FIG. 6B1.

FIG. 8A is a sectional view while the retainer is locked provisionally, FIG. 8B is a sectional view while the retainer is moving to a regular position, and FIG. 8C is across sectional view while the retainer is mounted to the regular position.

DESCRIPTION OF EMBODIMENTS

First Embodiment

Figure 1:
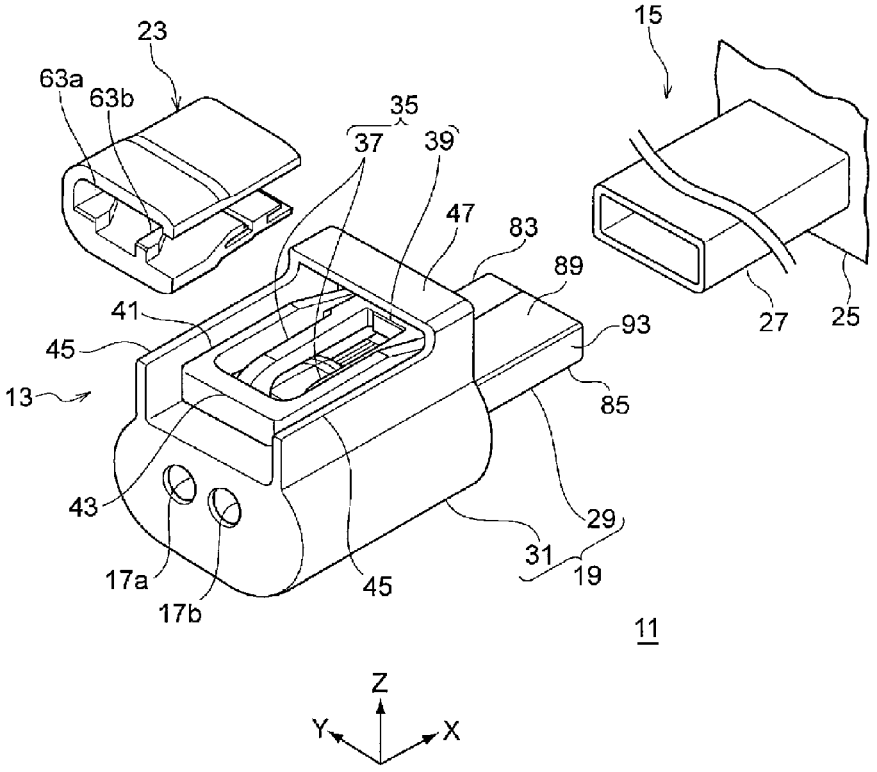
FIG. 1 is an exploded perspective view of a connector before a female connector and a mating male connector are engaged in a first embodiment.

Next, the first embodiment of the present invention is described with reference to the figures. FIG. 1 is an exploded perspective view of a connector 11 of the present embodiment. The connector 11 includes a female connector 13 which is a connector to which the present invention is applied, and a male connector 15 which is engaged with the female connector 13. In this embodiment, the connector to which the present invention is applied is described as the male connector 15, but it is also possible that the present invention is applied to the female connector 13. In the following description, the x direction of FIG. 1 is defined as a forward/backward direction, the Y direction as a widthwise direction, and the Z direction as a height direction, and the direction in which the connectors 13 and 15 are engaged is a forward direction.

Figure 2:
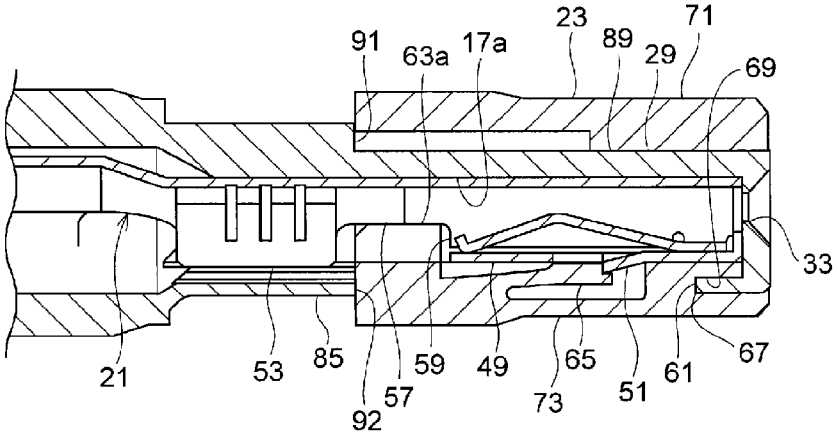
FIG. 2 is a partial sectional view of the female connector to which a retainer is mounted.

As shown in FIGS. 1 and 2, the female connector 13 includes a tubular female connector housing 19 made of synthetic resin in which female terminal accommodating rooms 17*a*, 17*b* are formed, female terminals 21 which are accommodated in the female terminal accommodating rooms 17*a*, 17*b*, and a retainer 23 which is mounted to the female connector housing 19 from the widthwise direction (lateral direction), and which retains the female terminals 21 accommodated in the female terminal accommodating rooms 17*a*, 17*b*. As shown in FIG. 1, the male connector 15 has a tubular ale connector housing 27 made of synthetic resin which is connected directly with an apparatus 25 that is carried in, for example, a vehicle, and in which male terminals not shown in the figure are accommodated.

The female connector housing 19 is formed by linking a tubular inner housing 29 and a tubular outer housing 31 which is spaced from the outer peripheral surface of the inner housing 29, and surrounds the outer peripheral surface. The inner housing 29 is formed to extend forward beyond the front end surface of the outer housing 31. The inner housing 29 has a cylindrical outer peripheral surface, which is surrounded in the outer housing 31 and to which an annular sealing member (not shown) is mounted. The inner housing 29 has a rectangular tubular outer peripheral surface which extends from the outer housing 31 and to which the retainer 23 is mounted. The male connector housing 27 is inserted into the gap between the outer peripheral surface of the inner housing 29 and the inner peripheral surface of the outer housing 31, and a gap between the outer peripheral surface of the inner housing 29 and the inner peripheral surface of the male connector housing 27 is sealed by the sealing member.

Two of the female terminal accommodating rooms 17*a*, 17*b* are placed side by side inside the inner housing 29. The female terminal accommodating rooms 17*a*, 17*b* are opened outward through insertion openings 33 formed at the front end of the inner housing 29, and tab-formed male terminals are inserted from the insertion openings 33. The female terminal accommodating rooms 17*a*, 17*b* are separated from each other by walls to be described below.

The outer peripheral surface of the inner housing 29 is formed with a housing arm 35 which projects to lock the two housings 19, 27 with each other when the two housings 19, 27 are engaged with each other. The housing arm 35 is formed into a gate-like shape as a whole, and has a pair of resilient arm pieces 37, which is supported into a cantilever shape on the outer peripheral surface of the inner housing 29 and extends forward substantially horizontally, and a locking piece 39 which bridges the front ends of the resilient arm pieces 37 in the widthwise direction. The locking piece 39 locks the two housings 19, 27 by locking a locking projection (not shown) which projects from the outer peripheral surface of the male connector housing 27 when the housings 19, 27 are engaged.

The housing arm 35 is elastically deformable so that the locking piece 39 may move upward with the back end of the housing arm 35 as a fulcrum. A gate-like locking arm 41 which is supported into a cantilever shape respectively on the front ends of the pair of resilient arm pieces 37, and which extends backward, is connected to the housing arm 35. The locking arm 41 has an operating member 43 which is pressed when the housing arm 35 is to be unlocked, and this operating member 43 is placed at a position that is higher than the resilient arm pieces 37.

The outer housing 31 is provided with a pair of protective walls 45 which stand and have an interval in the widthwise direction. The protective walls 45 are raised across the full length in the forward/backward direction of the outer housing 31, and protect the housing arm 35 and the locking arm 41, which are located at the inner side of these protective walls 45, from both sides in the widthwise direction. The front ends of the pair of protective walls 45 are bridged by a regulating wall 47 which regulates the housing arm 35 from being excessively bended.

Figure 3:
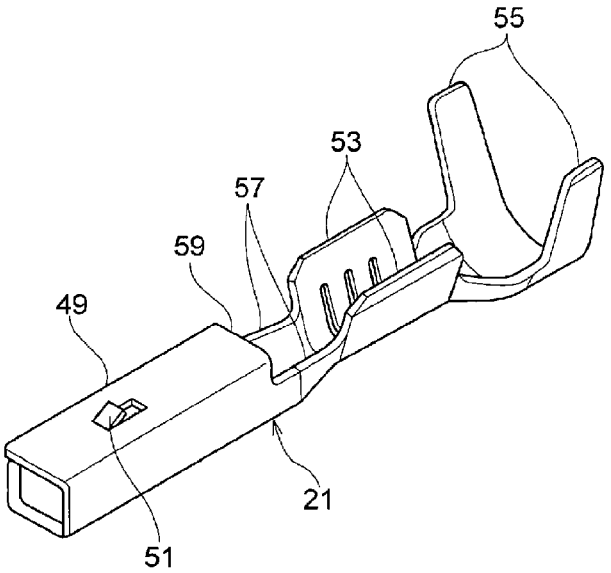
FIG. 3 is an external perspective view of the male terminal.

The female terminal 21 is a metal fitting which is tightened and connected to the end of an electric wire not shown in the figure. As shown in FIGS. 2 and 3, the female terminal 21 is formed with a rectangular tubular electrical contact part 49 which is electrically connected to a mating terminal (male terminal). The peripheral wall of the electrical contact part 49 is provided with a cut and raised part 51 which is cut and raised outward. The electrical contact part 49 presses the tab-formed male terminal, which is inserted inside, to be connected to the male terminal electrically. The female terminal 21 has, at the back side of the electrical contact part 49, a pair of conductor crimping parts 53, which tightens and crimps a conductor which is exposed from an insulative coating at the end of the electric wire, and a pair of electric wire crimping parts 55, which tightens and crimps the insulative coating at the end of the electric wire. A pair of side walls 57 which rise respectively from both sides in the widthwise direction is provided between the electrical contact part 49 and the conductor crimping parts 53, and the upper end surfaces of the side walls 57 are formed to be continuous with a back end surface 59 of the electrical contact part 49.

Figure 4:
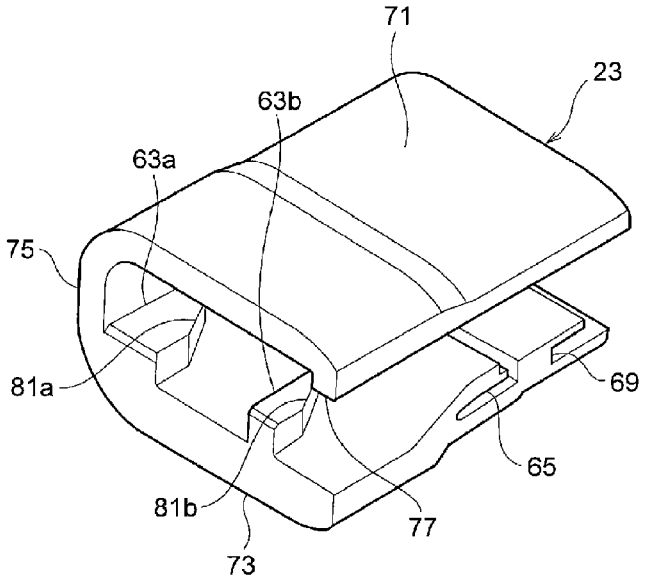
FIG. 4 is an external perspective view of the retainer.
Figure 5:
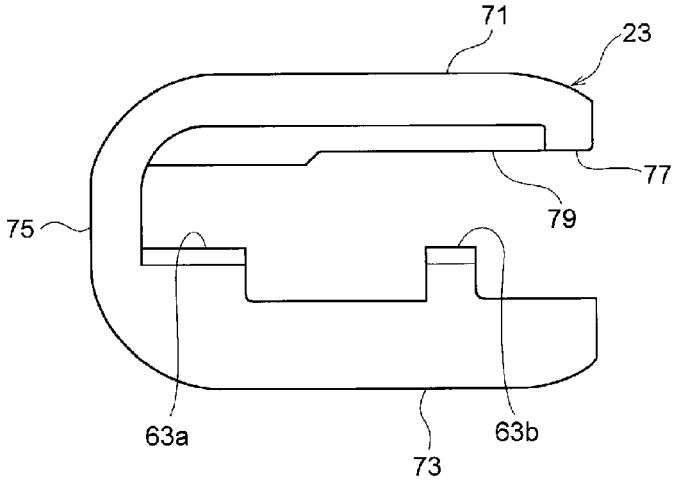
FIG. 5 is a side view of the retainer.

The retainer 23 is formed by injection-molding synthetic resin, and, as shown in FIGS. 4 and 5, is formed to have a U-like section to sandwich the inner housing 29 in the upward/downward direction. The retainer 23 has columnar terminal contact parts 63*a*, 63*b* which are inserted into the female terminal accommodating rooms 17*a*, 17*b* from an opening part 61, which the wall that surrounds the female terminal accommodating rooms 17*a*, 17*b* of the inner housing 29 is formed with, and touch the female terminals 21, which are accommodated in the female terminal accommodating rooms 17*a*, 17*b*, respectively, and a lance 65 which locks the cut and raised parts 51 of the female terminals 21 through the opening part 61. As shown in FIG. 2, the retainer 23 is provided with a rail-like groove part 69 which extends in the widthwise direction, and into which a front side edge 67 of the opening part 61 of the inner housing 29 is inserted. By making the retainer 23 slide after the front side edge 67 is inserted into the groove part 69, the retainer 23 is guided in a direction crossing (perpendicular to) the inserting direction of the female terminals 21, and mounted to a regular position of the inner housing 29.

As shown in FIGS. 4 and 5, the retainer 23 is formed with an upper board 71 and a lower board 73 which are opposed to each other and are supported with a side board 75. The upper board 71 has a first locking board 77 which projects from the end opposite to the side board 75 toward the lower board 73, and a second locking board 79 which projects from the front end toward the lower board 73. The terminal contact parts 63*a*, 63*b* are projected from the top surface, opposed to the upper board 71, of the lower board 73. The terminal contact parts 63*a*, 63*b* are formed to have a shape to respectively press the female terminals 21 to the front sides of the female terminal accommodating rooms 17*a*, 17*b* in the process that the retainer 23 moves until the regular position of the inner housing 29. That is, the terminal contact parts 63*a*, 63*b* are formed with inclined surfaces 81*a*, 81*b*, which are inclined toward a direction of pressing the female terminals 21 forward. These inclined surfaces 81*a*, 81*b* are formed to be inclined toward the front side of the retainer 23 at the side of the side board 75, and are located to have the same height in the direction of projecting toward the opening part 61.

The opening part 61 (FIG. 2) which the inner housing 29 is formed with, as shown in FIG. 1, is formed into a rectangular shape by cutting the side wall 83, at the side of the inner housing 29 where the retainer 23 is mounted in the widthwise direction, along a bottom wall 85 in the widthwise direction. The opening part 61 is formed into a shape to be opened to face the insides of the female terminal accommodating rooms 17*a*, 17*b* which are placed side by side, respectively. The opening part 61 is formed into such a shape that at least the back end surfaces 59 of the female terminals 21, which are inserted into the female terminal accommodating rooms 17*a*, 17*b* provisionally, and the area around the back end surfaces 59 in the forward/backward direction are opened outward. As shown in FIGS. 6A1 to 6B2, the female terminal accommodating rooms 17*a*, 17*b* are separated from each other by the walls 87. The wall 87 is formed by cutting apart where the terminal contact parts 63*a*, 63*b* pass in the process that the retainer 23 is mounted to the inner housing 29.

The upper wall 89 opposite to the lower wall 85 of the inner housing 29, as shown in FIG. 2, is formed with a stepped part 91 which extends in the widthwise direction and is opposed to the back end surface of the retainer 23. Thereby, when the front side edge part 67 of the opening part 61 is inserted into the groove 69, and the terminal contact parts 63*a*, 63*b* are inserted from the opening part 61 into the inner side of the inner housing 29, the back end surface of the upper board 71 of the retainer 23 is placed opposite to the stepped part, and the back end surface of the lower board 73 of the retainer 23 is placed opposite to a back side edge 92 of the opening part 61. As a result, a movement forward of the retainer 23 is regulated by the front side edge 67 of the opening part 61, and a movement backward of the retainer 23 is regulated by the stepped part 91 and the back side edge 92, respectively.

Then, the movement when the retainer 23 is mounted to the female connector housing 19 is described with reference to FIGS. 6A1 to 6B2. FIGS. 6A1 to 6B2 describe the movement when the retainer 23 is mounted to the inner housing 29. FIG. 6A1 is a front view and FIG. 6A2 is a sectional view from the A-A arrows of FIG. 6A1 to show that the retainer 23 is mounted provisionally. FIG. 6B1 is a front view and FIG. 6B2 is a sectional view from the B-B arrows of FIG. 6B1 to show that the retainer 23 is mounted to the regular position.

First, the sealing member not shown in the figure is mounted to the outer peripheral surface of the inner housing 29 which is located inside the outer housing 31, and the female terminals 21 to which electric wires are connected are inserted from behind to the female terminal accommodating rooms 17*a*, 17*b*, respectively. For the female terminal accommodating rooms 17*a*, 17*b*, as shown in FIG. 6A2, the walls 87 forming the female terminal accommodating rooms 17*a*, 17*b*, respectively, are cut at the course where the terminal contact parts 63*a*, 63*b* of the retainer 23 pass, and the female terminals 21 which are provisionally inserted respectively into the female terminal accommodating rooms 17*a*, 17*b* are placed so that the back end surface 59 and the area around the back end surface 59 in the forward/backward direction are located on the course.

Then, the retainer 23 is provisionally mounted to the inner housing 29 which extends from the outer housing 31. In this case, the front side edge 67 of the opening part 61 of the inner housing 29 is inserted into the groove part 69 of the retainer 23, and the terminal contact parts 63*a*, 63*b* of the retainer 23 are inserted into the inner side of the inner housing 29 from the opening part 61. At this time, the terminal contact parts 63*a*, 63*b*, as shown in FIG. 6A2 are so placed that the inclined surfaces 81*a*, 81*b*, which are located at the inner sides of the male terminal accommodating rooms 17*a*, 17*b*, respectively, touch the back end surface 59 of the female terminals 21, respectively. Further, at this time, the retainer 23 does not need to necessarily touch the female terminals 21.

Then, by pushing the retainer 23 which is provisionally mounted to the inner housing 29 along the front side edge 67 inside, the retainer 23 is moved in the widthwise direction (direction perpendicular to the inserting direction of the female terminals 21) of the inner housing 29, and the retainer 23 is located at the regular position of the inner housing 29. The retainer 23 which is located at the regular position is locked to the inner housing 29 by making the first locking board 77 locked to the side wall 93 opposite to the side wall 83 of the inner housing 29 (FIG. 1).

On the other hand, in the process that the retainer 23 moves from the position where the retainer 23 is provisionally mounted to the regular position, the retainer 23 moves while the inclined surfaces 81*a*, 81*b* of the terminal contact parts 63*a*, 63*b* respectively press the back end surfaces 59 of the female terminals 21. Thereby, the movement of the female terminals 21 in the moving direction of the terminal contact parts 63*a*, 63*b*, that is, a direction perpendicular to the inserting direction of the female terminals 21 is converted into the movement of the inserting direction of the female terminals 21 by the inclined surfaces 81*a*, 81*b*, and the female terminals 21 are pushed to the front sides of the female terminal accommodating rooms 17*a*, 17*b*.

The female terminals 21, which are pushed to the front sides of the female terminal accommodating rooms 17*a*, 17*b*, respectively, as shown in FIG. 2, move while making the lance 65, which extends inside the female terminal accommodating rooms 17*a*, 17*b* through the opening part 61, bend outward, and when the lance 65 is overridden, the cut and raised part 51 is locked to the lance 65. Further, when the retainer 23 is mounted to the regular position of the inner housing 29, as shown in FIG. 6B2, the movement backward of the female terminals 21 is regulated by the terminal contact parts 63*a*, 63*b*. Thereby, the female terminals 21 are locked by both the lance 65 and the terminal contact parts 63, respectively, and the state that the female terminals 21 are completely inserted into the female terminal accommodating rooms 17*a*, 17*b* is maintained.

According to the present embodiment, as shown in FIGS. 6A1 to 6B2, because the movement backward can be regulated while the female terminals 21 which are accommodated in the female terminal accommodating rooms 17*a*, 17*b* are pushed forward by the terminal contact parts 63*a*, 63*b*, the amount of the looseness of the female terminals 21 (amount to move in the forward/backward direction) can be decreased from L1 to L2, and the looseness of the female terminals 21 can be inhibited. Thereby, while the shock resistance of the connector 11 is raised, the contact reliability of the female terminals 21 and the mating male terminals can be improved.

Further, in the case of the present embodiment, because the retainer 23 is so formed that the inclined surfaces 81*a*, 81*b*, which the terminal contact parts 63*a*, 63*b* are formed with, make the female terminals 21 move in the inserting direction, respectively, regardless of the mounting direction of the retainer 23, with a simple constitution, the female terminals 21 can be moved forward and the design flexibility of the retainer 23 can be raised.

In the following, other embodiments to carry out the present invention are described. But each of these embodiments is basically similar to the first embodiment. Therefore, in the following, only those constitutions that are characteristic of each embodiment are described, but those common constitutions to the first embodiment are just given the same signs and their description is omitted.

Second Embodiment

Figure 7:
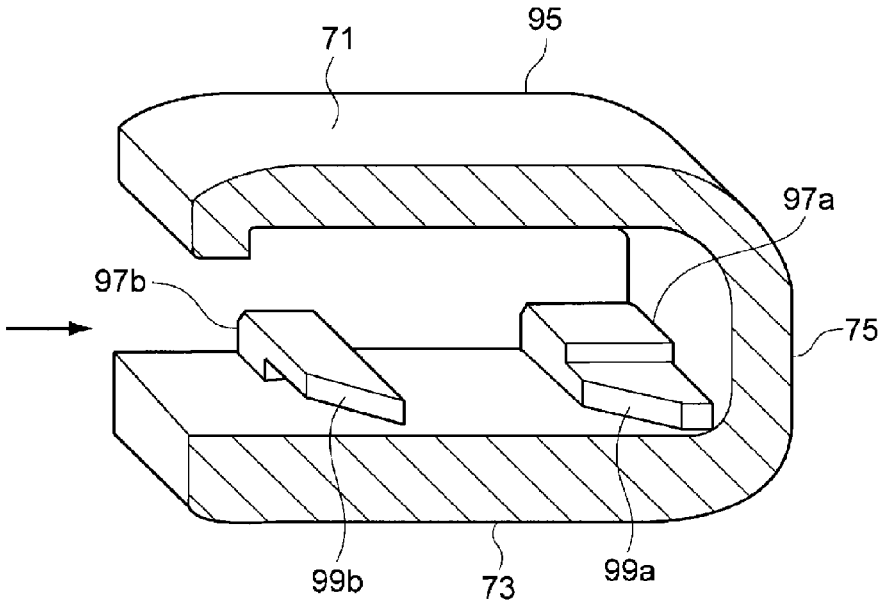
FIG. 7 is a cross sectional view which indicates the feather of a retainer of a second embodiment.

The constitution of the feature of a retainer 95 of the present embodiment is shown in FIG. 7. The present embodiment differs from the first embodiment in that, the positions of inclined surfaces 99*a*, 99*b* of terminal contact parts 97*a*, 97*b*, are not the same in the height direction. That is, the positions of the inclined surfaces 99*a*, 99*b* in the direction of projecting toward the opening part 61 are shifted from each other. The terminal contact parts 97*a*, 97*b* of the present embodiment are so placed that the position in the height direction of the other inclined surface 99*b* is shifted upward from the one inclined surface 99*a*, and the longitudinal section of the terminal contact part 97*b* is formed into an L-like shape. That is, the terminal contact part 97*b* is so formed that the inclined surface 99*b* is located at a position which is lifted from the lower board 73 by at least the thickness of the inclined surface 99*a*. Further, the female terminals 21 which are accommodated in the female terminal accommodating rooms 17*a*, 17*b* respectively, are placed at the same height as each other.

In this embodiment, the positions where the terminal contact parts 97*a*, 97*b* press against the female terminals 21, respectively, are different in the height direction, but both of the terminal contact parts 97*a*, 97*b* are so formed that the back end surfaces 59 of the female terminals 21 are pushed forward the same amount.

According to the present embodiment, because like the above embodiment, the movement backward can be regulated while the female terminals 21 which are accommodated in the female terminal accommodating rooms 17*a*, 17*b* are pushed forward by the terminal contact parts 97*a*, 97*b*, the looseness of the female terminals 21 is inhibited, and the contact reliability of the female terminals 21 and the mating male terminals can be improved. Thereby, while the shock resistance of the connector 11 is raised, the contact reliability of the female terminals 21 and the mating male terminals can be improved.

In the case that resin is filled in a metal mold to injection-mold the retainer 95, in the first embodiment, because of undercutting when a slide mold enters a cavity from the direction of the arrow of FIG. 7, the two inclined surfaces 99*a*, 99*b* cannot be molded at the same time. In this regard, in the present embodiment, because the two inclined surfaces 99*a*, 99*b* are shifted in position to not overlap over each other in the height direction, the two inclined surfaces 99*a*, 99*b* can be molded with one slide mold at the same time from the direction of the arrow, and as a result, the design flexibility of the metal mold can be raised.

Third Embodiment

The constitutions of the inner housing 29 and a retainer 101 of the present embodiment and the movement when the retainer 101 pushes out the female terminals 21 is shown in FIG. 8. The present embodiment differs from the first embodiment in that when the retainer 101 moves diagonally toward the inserting direction of the female terminals 21, the planar parts of the retainer 101 which extend in a direction that is perpendicular to the inserting direction of the female terminals 21 are pressed against the female terminals 21, and the female terminals 21 are pushed to the front sides of the female terminal accommodating rooms 17*a*, 17*b*.

The inner housing 29 is formed with guiding surfaces 103*a*, 103*b* which are inclined in a direction of guiding the retainer 101 to the front sides of the female terminal accommodating rooms 17*a*, 17*b*, at the back side edge 92 of the opening part 61, respectively. The retainer 101 has terminal contact parts 105*a*, 105*b* which touch the female terminals 21 which are accommodated in the female terminal accommodating rooms 17*a*, 17*b*, respectively while the retainer 101 is inserted into the opening part 61. The terminal contact parts 105*a*, 105*b* have at the front end surface planar parts which extend in the widthwise direction of the inner housing 29, that is, a direction that is perpendicular to the inserting direction of the female terminals 21, and press against the back end surfaces 59 of the female terminals 21, respectively. The terminal contact parts 105*a*, 105*b* have at the back end surfaces sliding surfaces 107*a*, 107*b* which are inclined at an angle corresponding to the guiding surfaces 103*a*, 103*b* and slide along the guiding surfaces 103*a*, 103*b*. Thereby, in the process that the retainer 101 moves to the regular position of the inner housing 29, the sliding surfaces 107*a*, 107*b* slide along the guiding surfaces 103*a*, 103*b*, and the planar parts of the terminal contact parts 105*a*, 105*b* push the female terminals 21 forward.

The walls 87 forming the female terminal accommodating rooms 17*a*, 17*b*, as shown in FIG. 8, are formed by cutting those parts which the terminal contact parts 105*a*, 105*b* pass. Further, at least part of the wall 87 of the terminal accommodating room 17*a*, at the side where the retainer 101 is mounted, is formed of a wall 109 which is continuous with the terminal contact part 105*a* of the retainer 101.

Figure 8A:
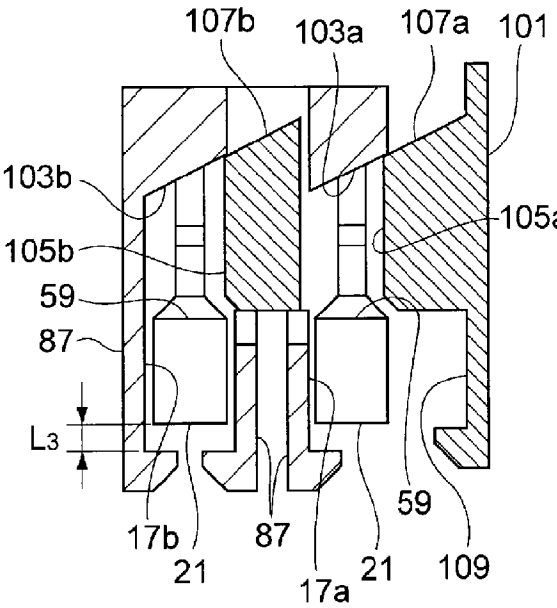
FIGS. 8A to 8C describe the movement of a retainer of a third embodiment.
Figure 8B:
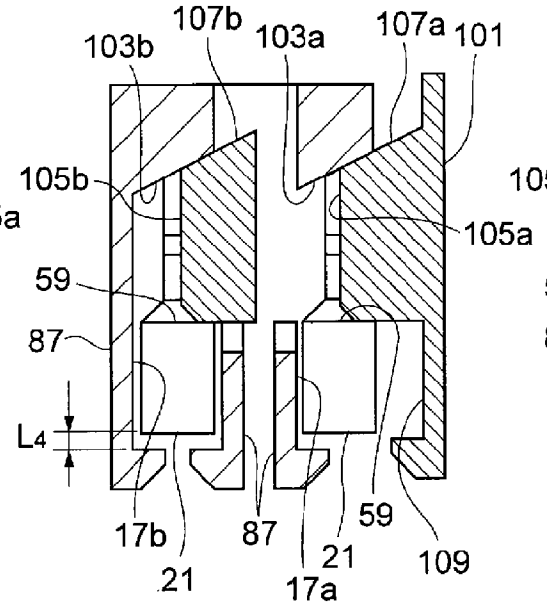
Figure 8C:
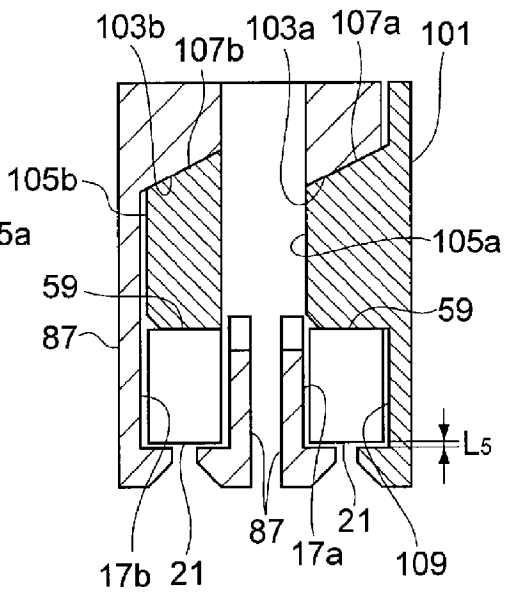

As shown in FIG. 8A, when the retainer 101 which is provisionally mounted to the inner housing 29 is pushed in the widthwise direction of the inner housing 29, as shown in FIG. 8B, the sliding surfaces 107*a*, 107*b* move along the guiding surfaces 103*a*, 103*b*, respectively. Thereby, the retainer 101 moves diagonally toward the inserting direction of the female terminals 21, and the female terminals 21 are pushed in the inserting direction by the terminal contact parts 105*a*, 105*b*. Then, as shown in FIG. 8C, when the retainer 101 is mounted to the regular position of the inner housing 9, the movement backward of the female terminals 21 is regulated by the planar terminal contact parts 105*a*, 105*b* that extend in the direction perpendicular to the inserting direction of the female terminals 21.

According to the present embodiment, because the movement backward can be regulated while the female terminals 21 which are accommodated in the female terminal accommodating rooms 17*a*, 17*b* are pushed forward by the terminal contact parts 105*a*, 105*b*, the amount of the looseness of the female terminals 21 can be decreased from L3 to L5, and the looseness of the female terminals 21 can be inhibited. Thereby, while the shock resistance of the connector 11 is raised, the contact reliability of the female terminals 21 and the mating male terminals can be improved. Further, in the present embodiment, because the whole back end surfaces 59 of the female terminals 21 can be locked by the terminal contact parts 105*a*, 105*b* which are formed into a planar shape, the retentivity of the female terminals 21 can be stabilized.

Although several embodiments to carry out the present invention have been described above, these embodiments are only exemplary, and the present invention can be carried out with various embodiments without departing from the spirit and scope of the present invention.

For example, in the first and the second embodiments, it is described as examples that the back end surfaces 59 of the female terminals 21 are locked by the terminal contact parts 63*a*, 63*b* of the retainer 23, but the sites to lock the female terminals 21 are not limited to the back end surfaces 59, and other sites which the terminal contact parts 63*a*, 63*b* can be pressed against are also possible.

In the above embodiments, in FIG. 2, it is described as examples that the cut and raised parts 51 of the female terminals 21 are locked to the lance 65 of the retainer 23, and the female terminals 21 are locked by both the lance 65 and the terminal contact parts 63*a*, 63*b*, but if the female terminal contact parts 63*a*, 63*b* are included, the lance 65 can be omitted.

What is claimed is:

1. A connector comprising:

a tubular connector housing inside which a terminal accommodating room is formed;

a terminal that is inserted into the terminal accommodating room from behind; and a retainer that retains the terminal which is accommodated in the terminal accommodating room by being mounted to the connector housing from a direction crossing the inserting direction of the terminal, wherein the retainer is formed with a terminal contact part which is inserted from an opening, with which a wall of the terminal accommodating room of the connector housing is formed, to touch the terminal which is accommodated in the terminal accommodating room, and the terminal contact part is formed into such a shape to push the terminal toward the front side of the terminal accommodating room in a process that the retainer moves to a regular position of the connector housing.

2. The connector according to claim 1, wherein the terminal contact part is formed to have an inclined surface which is inclined toward a direction of pushing the terminal toward the front side of the terminal accommodating room.

3. The connector according to claim 2, wherein the connector housing is formed with a plurality of the terminal accommodating rooms which are placed side by side, the retainer has a plurality of the terminal contact parts which correspond to the terminal accommodating rooms, respectively, and the terminal contact parts are provided at positions that are shifted from each other so that the inclined surfaces do not overlap in the direction of projecting toward the opening.

4. The connector according to claim 1, wherein the connector housing is formed at the opening with a guiding surface which is inclined in a direction of guiding the retainer to the front side of the terminal accommodating room, the retainer has a sliding surface to slide along the guiding surface, and the surface that touches the terminal of the terminal contact part is formed into a planar shape to extend in a direction perpendicular to the inserting direction of the terminal.

5. A connector comprising:

a tubular connector housing that includes a terminal accommodating room and an opening, the terminal accommodating room extends in an inserting direction, and the opening is in communication with the terminal accommodating room;

a terminal that is inserted into the terminal accommodating room from behind; and a retainer that is movable from a first position to a second position in a direction crossing the inserting direction, where the terminal is unsecured in the terminal accommodating room when the retainer is in the first position and the terminal is retained in the terminal accommodating room by the retainer when the retainer is in the second position, wherein the retainer includes a terminal contact part which is inserted into the opening and touches the terminal as the retainer moves in the direction crossing the insertion direction from the first position to the second position, and the terminal contact part includes a contact surface that pushes the terminal in the inserting direction and toward a front side of the terminal accommodating room as the retainer moves in the direction crossing the inserting direction from the first position to the second position.

6. The connector according to claim 5, wherein the contact surface is an inclined surface which is inclined toward the front side of the terminal accommodating room such that the terminal is pushed in the inserting direction and toward the front side of the terminal accommodating room as the retainer moves in the direction crossing the inserting direction from the first position to the second position.

7. The connector according to claim 6, wherein the connector housing includes a plurality of the terminal accommodating rooms which are placed side by side, the retainer has a plurality of the terminal contact parts which correspond to the terminal accommodating rooms, respectively, and one of the terminal contact parts is spaced from the opening by a distance that is different from that by which another one of the terminal contact parts is spaced from the opening.

8. The connector according to claim 5, wherein the connector housing further includes a guiding surface located at the opening, the guiding surface is inclined in a direction of guiding the retainer toward the front side of the terminal accommodating room, the retainer has a sliding surface that slides along the guiding surface such that the retainer moves in the inserting direction and in the direction crossing the inserting direction as the retainer moves from the first position to the second position, and the contact surface has a planar shape that extends in a direction perpendicular to the inserting direction of the terminal.

* * * * *